US009141121B2

(12) United States Patent
Nihei et al.

(10) Patent No.: US 9,141,121 B2
(45) Date of Patent: Sep. 22, 2015

(54) VOLTAGE REGULATOR

(71) Applicant: Seiko Instruments Inc., Chiba-shi, Chiba (JP)

(72) Inventors: Yotaro Nihei, Chiba (JP); Manabu Fujimura, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 62 days.

(21) Appl. No.: 14/015,112

(22) Filed: Aug. 30, 2013

(65) Prior Publication Data

US 2014/0070778 A1 Mar. 13, 2014

(30) Foreign Application Priority Data

Sep. 7, 2012 (JP) ..... 2012-197540
Jun. 13, 2013 (JP) ..... 2013-124723

(51) Int. Cl.
*G05F 1/571* (2006.01)
*G05F 1/575* (2006.01)

(52) U.S. Cl.
CPC ..... *G05F 1/571* (2013.01); *G05F 1/575* (2013.01)

(58) Field of Classification Search
CPC ..... G05F 1/465; G05F 1/56; G05F 1/562; G05F 1/565; G05F 1/571; G05F 1/575
See application file for complete search history.

(56) References Cited

U.S. PATENT DOCUMENTS 6,084,386 A * 7/2000 Takahashi et al. ..... 323/273
7,906,952 B2 * 3/2011 Kuo et al. ..... 323/284
2007/0108950 A1 * 5/2007 Kakinuma ..... 323/280

FOREIGN PATENT DOCUMENTS

JP 2005-301439 A 10/2005

* cited by examiner

*Primary Examiner* — Fred E Finch, III
(74) *Attorney, Agent, or Firm* — Brinks Gilson & Lione

(57) ABSTRACT

Provided is a voltage regulator capable of suppressing excessive overshoot at the output terminal when the power supply fluctuates in a non-regulate state. The voltage regulator includes: an error amplification circuit that amplifies a difference between reference voltage and divided voltage, thus controlling a gate of an output transistor; an amplifier that compares the reference voltage and the divided voltage to detect overshoot at the output voltage; a first transistor that lets current that is proportional to current flowing through the output transistor pass therethrough; a current mirror circuit that mirrors current that is proportional to the current flowing through the output transistor; and a first bias circuit connected to the amplifier via the current mirror circuit, the first bias circuit increasing bias current of the amplifier to increase a response speed.

9 Claims, 7 Drawing Sheets

VOLTAGE REGULATOR

RELATED APPLICATIONS

This application claims priority under 35 U.S.C. §119 to Japanese Patent Application Nos. 2012-197540 filed on Sep. 7, 2012 and 2013-124723 filed on Jun. 13, 2013, the entire content of which are hereby incorporated by reference.

BACKGROUND OF THE INVENTION

1. Field of the Invention

The present invention relates to an overshoot suppression circuit for voltage regulator.

2. Background Art

The following describes a conventional voltage regulator. FIG. 5 is a circuit diagram showing a conventional voltage regulator.

The conventional voltage regulator includes: an error amplification circuit 104; an amplifier 110, bias circuits 108 and 111, a reference voltage circuit 109, PMOS transistors 114 and 105 and resistors 106 and 107.

The PMOS transistor 105 is connected between a power supply terminal 101 and an output terminal 103. The resistors 106 and 107 outputting feedback voltage are connected between the output terminal 103 and a ground terminal 100. The error amplification circuit 104 has an inverting input terminal, to which the reference voltage circuit 109 is connected, a non-inverting terminal, to which the feedback voltage is input, and an output terminal, to which a gate of the PMOS transistor 105 is connected. The bias circuit 108 supplies operating current to the error amplification circuit 104. The PMOS transistor 114 is connected between the power supply terminal 101 and the gate of the PMOS transistor 105. The amplifier 110 has a non-inverting terminal, to which the reference voltage circuit 109 is connected, an inverting terminal, to which the feedback voltage is input and an output terminal connected to a gate of the PMOS transistor 114. The bias circuit 111 supplies operating current to the amplifier 110.

The amplifier 110 compares the input feedback voltage and a reference voltage generated at the reference voltage circuit 109. When the feedback voltage is lower than the reference voltage, the amplifier 110 outputs a Hi signal, thus turning the PMOS transistor 114 OFF. If overshoot generated at the voltage of the output terminal 103 makes the feedback voltage higher than the reference voltage, then the amplifier 110 outputs a Lo signal, thus turning the PMOS transistor 114 ON.

The conventional voltage regulator is operated in this way, thus preventing an increase of the overshoot of the voltage of the output terminal 103 (see Patent Document 1, for example).

[Patent Document 1] Japanese Patent Application Laid-Open No. 2005-301439

SUMMARY OF THE INVENTION

The conventional voltage regulator, however, has a problem that, when the power supply voltage is low and the output terminal 103 outputs voltage lower than a set output voltage (hereinafter this called a non-regulate state), excessive overshoot occurs at the output terminal 103 when the power supply voltage fluctuates.

In view of such a problem, it is an object of the present invention to provide a voltage regulator capable of suppressing excessive overshoot at the output terminal 103 when the power supply fluctuates in a non-regulate state.

In order to solve the conventional problem, a voltage regulator of the present invention is configured as follows.

A voltage regulator includes: an error amplification circuit that amplifies a difference between reference voltage and divided voltage, thus controlling a gate of an output transistor; an amplifier that compares the reference voltage and the divided voltage to detect overshoot at the output voltage; a first transistor that lets current that is proportional to current flowing through the output transistor pass therethrough; a current mirror circuit that mirrors current that is proportional to the current flowing through the output transistor; and a first bias circuit connected to the amplifier via the current mirror circuit, the first bias circuit increasing bias current of the amplifier to increase a response speed of the amplifier.

A voltage regulator provided with an overshoot suppression circuit of the present invention can suppress overshoot at the voltage of an output terminal when power supply fluctuates from a non-regulate state.

DESCRIPTION OF THE PREFERRED EMBODIMENTS

The following describes embodiments of the present invention, with reference to the drawings.

<First Embodiment>

Figure 1:
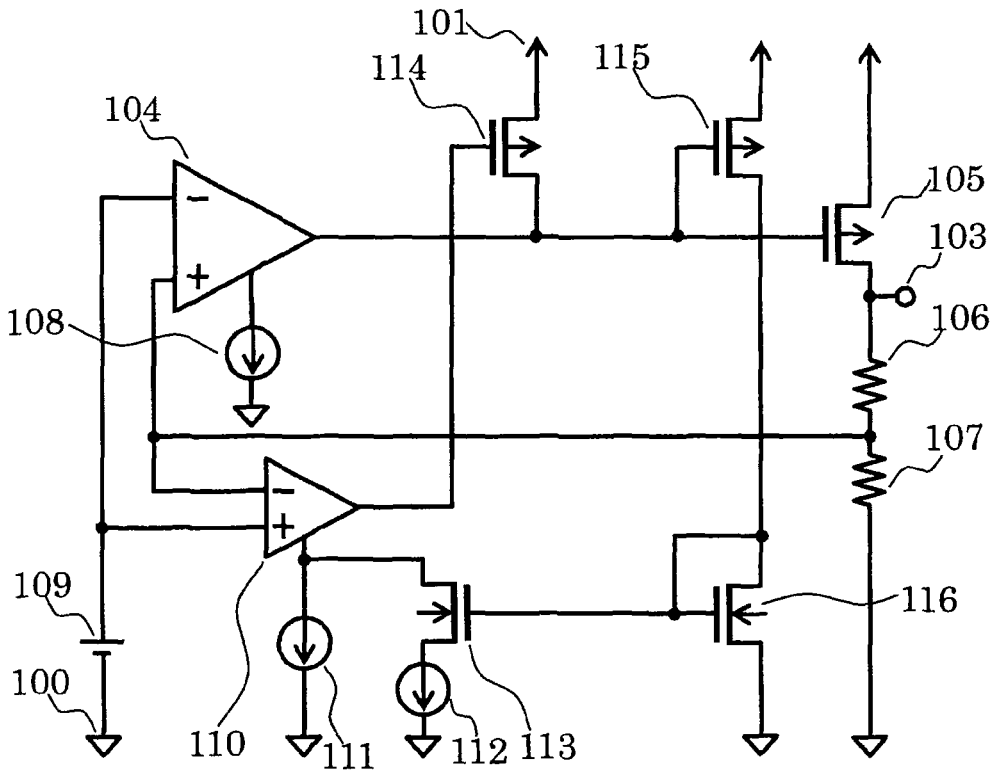
FIG. 1 is a circuit diagram of a voltage regulator according to a first embodiment.

FIG. 1 is a circuit diagram of a voltage regulator according to a first embodiment.

The voltage regulator of the first embodiment includes: a PMOS transistor 105 as an output transistor; an error amplification circuit 104; resistors 106 and 107; a bias circuit 108; a reference voltage circuit 109; an amplifier 110; bias circuits 111 and 112; PMOS transistors 114 and 115; NMOS transistors 113 and 116; a ground terminal 100; an output terminal 103; and a power supply terminal 101.

The following describes a connection in the voltage regulator of the first embodiment.

The error amplification circuit 104 has an inverting terminal connected to one of terminals of the reference voltage circuit 109 and a non-inverting terminal connected to a connection point between the resistors 106 and 107. The bias circuit 108 has one terminal connected to the error amplification circuit 104 and the other terminal connected to the ground terminal 100. The amplifier 110 has a non-inverting terminal connected to the one terminal of the reference voltage circuit 109 and an inverting terminal connected to the connection point between the resistors 106 and 107. The bias circuit 111 has one terminal connected to the amplifier 110 and the other terminal connected to the ground terminal 100.

The PMOS transistor 105 has a gate connected to an output terminal of the error amplification circuit 104, a source connected to the power supply terminal 101 and a drain connected to the output terminal 103. The resistors 106 and 107 are connected between the output terminal 103 and the ground terminal 100. The PMOS transistor 114 has a gate connected to an output terminal of the amplifier 110, a source connected to the power supply terminal 101 and a drain connected to the gate of the PMOS transistor 105. The PMOS transistor 115 has a gate connected to the output terminal of the error amplification circuit 104 and a source connected to the power supply terminal 101. The NMOS transistor 116 has a gate and a drain connected to the drain of the PMOS transistor 115 and a source connected to the ground terminal 100. The NMOS transistor 113 has a gate connected to the gate and the drain of the NMOS transistor 116, a drain connected to a connection point between the amplifier 110 and the bias circuit 111 and a source connected to one terminal of the bias circuit 112. The other terminal of the bias circuit 112 is connected to the ground terminal 100.

Next, the following describes an operation of the voltage regulator of the first embodiment.

When power supply voltage VDD is input to the power supply terminal 101, the voltage regulator outputs output voltage Vout from the output terminal 103. The resistors 106 and 107 divide the output voltage Vout and output a divided voltage Vfb. The error amplification circuit 104 compares the divided voltage Vfb with reference voltage Vref of the reference voltage circuit 109 and controls gate voltage of the PMOS transistor 105 so that the output voltage Vout becomes constant.

When the output voltage Vout is higher than predetermined voltage, then the divided voltage Vfb becomes higher than the reference voltage Vref. This means that the output signal of the error amplification circuit 104 (gate voltage of the PMOS transistor 105) becomes high, thus turning the PMOS transistor 105 OFF and decreasing the output voltage Vout. When the output voltage Vout is lower than the predetermined voltage, the opposite procedure to the above is performed, thus increasing the output voltage Vout. In this way, the voltage regulator operates so that the output voltage Vout becomes constant.

When the power supply voltage VDD is input to the power supply terminal 101 and the power supply voltage VDD is still low, the voltage of the output terminal 103 is lower than predetermined voltage, i.e., the voltage regulator is in a non-regulate state. In such a non-regulate state, since the output voltage Vout of the output terminal 103 is lower than the predetermined voltage, the error amplification circuit 104 outputs a signal Lo to the gate of the PMOS transistor 105 so that the voltage of the output terminal 103 becomes high. Since the PMOS transistor 115 has a current mirror relationship with the PMOS transistor 105, the PMOS transistor 115 similarly receives the signal Lo as an input and turns ON to let current pass therethrough. The NMOS transistor 116 and the NMOS transistor 113 make up a current mirror circuit such that the NMOS transistor 116 lets current from the PMOS transistor 115 pass therethrough, whereby the current flows through the NMOS transistor 113. The bias circuit 112 limits current flowing through the NMOS transistor 113, and so the current flowing through the NMOS transistor 113 can be kept to be the same current as the current flowing through the bias circuit 112 irrespective of an increase of the current flowing through the PMOS transistor 115. In this way, the current of the bias circuit 112 flows as bias current of the amplifier 110, thus enabling quick response of the amplifier 110.

If the power supply voltage VDD rapidly changes beyond the predetermined voltage of the output voltage, large current flows through the PMOS transistor 105 because the PMOS transistor 105 is ON, so that large overshoot occurs at the output terminal 103 of the voltage regulator. Such overshoot causes the amplifier 110 to output a signal Lo to the gate of the PMOS transistor 114 because the divided voltage Vfb of the inverting input terminal becomes higher than the reference voltage Vref. Further, since the amplifier 110 is in a quick responsible state, it can detect the overshoot quickly and can output the signal Lo to the gate of the PMOS transistor 114 quickly. In this way, the PMOS transistor 114 turns ON, so that voltage of the gate of the PMOS transistor 105 increases. This can prevent the overshoot of the output terminal 103 of the voltage regulator.

As stated above, the voltage regulator of the first embodiment increases bias current of the amplifier 110 in the non-regulate state, whereby if overshoot occurs at the output terminal 103, the overshoot can be detected quickly and the overshoot in the non-regulate state can be prevented.

<Second Embodiment>

Figure 2:
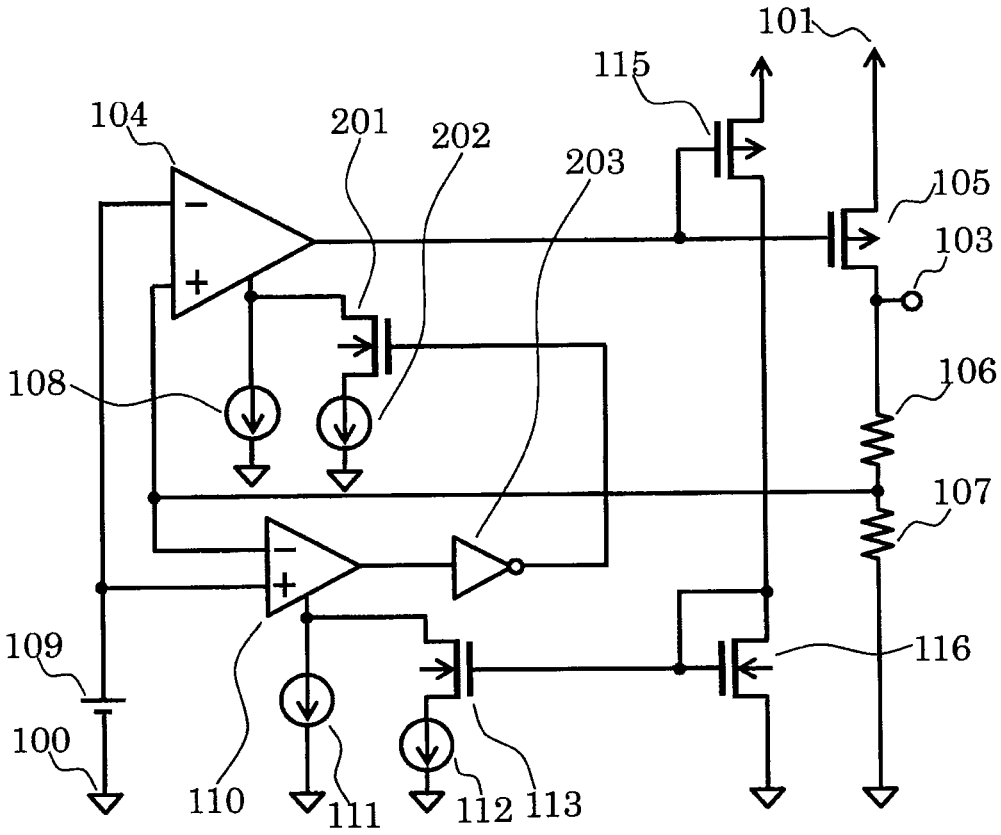
FIG. 2 is a circuit diagram of a voltage regulator according to a second embodiment.

FIG. 2 is a circuit diagram of a voltage regulator according to a second embodiment. This is different from FIG. 1 in that, instead of the PMOS transistor 114, a NMOS transistor 201, a bias circuit 202 and an inverter 203 are provided. The NMOS transistor 201 and the bias circuit 202 are connected in parallel with the bias circuit 108. To a gate of the NMOS transistor 201, an output of the inverter 203 is connected, and to an input of the inverter 203, an output of the amplifier 110 is connected.

Next, the following describes an operation of the voltage regulator of the second embodiment. The operation in a normal state is similar to the voltage regulator of the first embodiment, and so the description is omitted. The detection operation of overshoot in the non-regulate state also is similar, and so the description is omitted.

The voltage regulator of the second embodiment is configured so that, if the amplifier 110 detects overshoot with variation in the divided voltage Vfb, then the amplifier 110 outputs a signal to turn the NMOS transistor 201 ON via the inverter 203. Then, the bias circuit 202 connects to the error amplification circuit 104, whereby bias current of the error amplification circuit 104 can be increased.

The error amplification circuit 104 operates to output voltage at a level close to the power supply voltage and so attempts to turn the PMOS transistor 105 OFF, thus decreasing this overshoot. Since the bias current of the error amplification circuit 104 increases, driving current as the output increases, and so duration to charge gate capacity of the PMOS transistor 105 can be shortened, thus enabling quick turning-OFF of the PMOS transistor 105. In this way, the voltage regulator of the second embodiment can prevent overshoot.

As stated above, the voltage regulator of the second embodiment increases bias current of the amplifier 110 in the non-regulate state, whereby if overshoot occurs at the output terminal 103, the overshoot can be detected quickly and the driving current of the error amplification circuit 104 can be increased. Then, the PMOS transistor 105 can be controlled quickly and so overshoot in the non-regulate state can be prevented.

<Third Embodiment>

Figure 3:
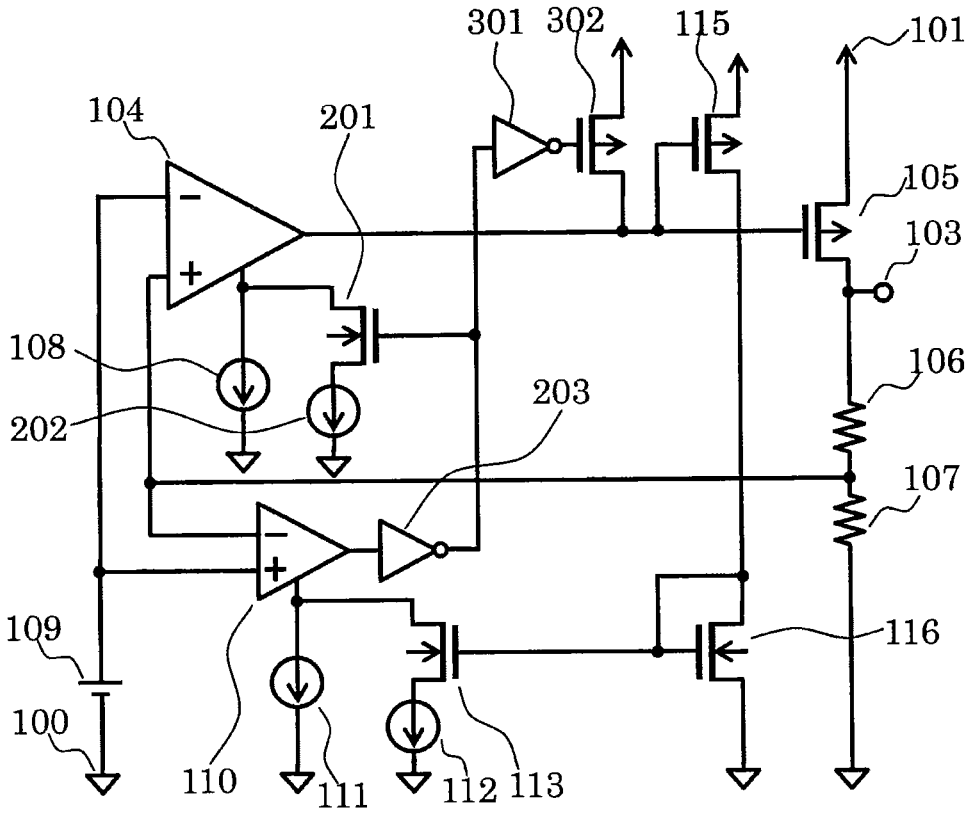
FIG. 3 is a circuit diagram of a voltage regulator according to a third embodiment.

FIG. 3 is a circuit diagram of a voltage regulator according to a third embodiment. This is different from FIG. 2 in that an inverter 301 and a PMOS transistor 302 are provided. The PMOS transistor 302 has a gate, to which an output of the amplifier 110 is connected via the inverters 301 and 203, a drain connected to the gate of the PMOS transistor 105 and a source connected to the power supply terminal 101.

Next the following describes an operation of the voltage regulator of the third embodiment. The operation in a normal state is similar to the voltage regulator of the first embodiment, and so the description is omitted. The detection operation of overshoot in the non-regulate state also is similar, and so the description is omitted.

The voltage regulator of the third embodiment is configured so that, if the amplifier 110 detects overshoot with variation in the divided voltage Vfb, then the amplifier 110 outputs a signal to turn the NMOS transistor 201 ON via the inverter 203. Then, the bias circuit 202 connects to the error amplification circuit 104, whereby bias current of the error amplification circuit 104 can be increased.

The error amplification circuit 104 operates to output voltage at a level close to the power supply voltage and so attempts to turn the PMOS transistor 105 OFF, thus decreasing this overshoot. Since the bias current of the error amplification circuit 104 increases, driving current increases, and so duration to charge gate capacity of the PMOS transistor 105 can be shortened, thus enabling quick turning-OFF of the PMOS transistor 105. The PMOS transistor 302 further receives a signal from the amplifier 110 via the inverter 301, thus controlling the gate of the PMOS transistor 105 to be at voltage at a level close to the power supply voltage. In this way, the voltage regulator of the third embodiment can prevent overshoot.

As stated above, the voltage regulator of the third embodiment increases bias current of the amplifier 110 in the non-regulate state, whereby if overshoot occurs at the output terminal 103, the overshoot can be detected quickly, the driving current of the error amplification circuit 104 can be increased, and the PMOS transistor 302 can be turned ON. Then the PMOS transistor 105 can be controlled quickly and so overshoot in the non-regulate state can be prevented.

Note here that as long as the NMOS transistor 201 and the PMOS transistor 302 turn ON by receiving the detected signal of the amplifier 110, the controlling method thereof is not limited to this circuit.

<Fourth Embodiment>

Figure 4:
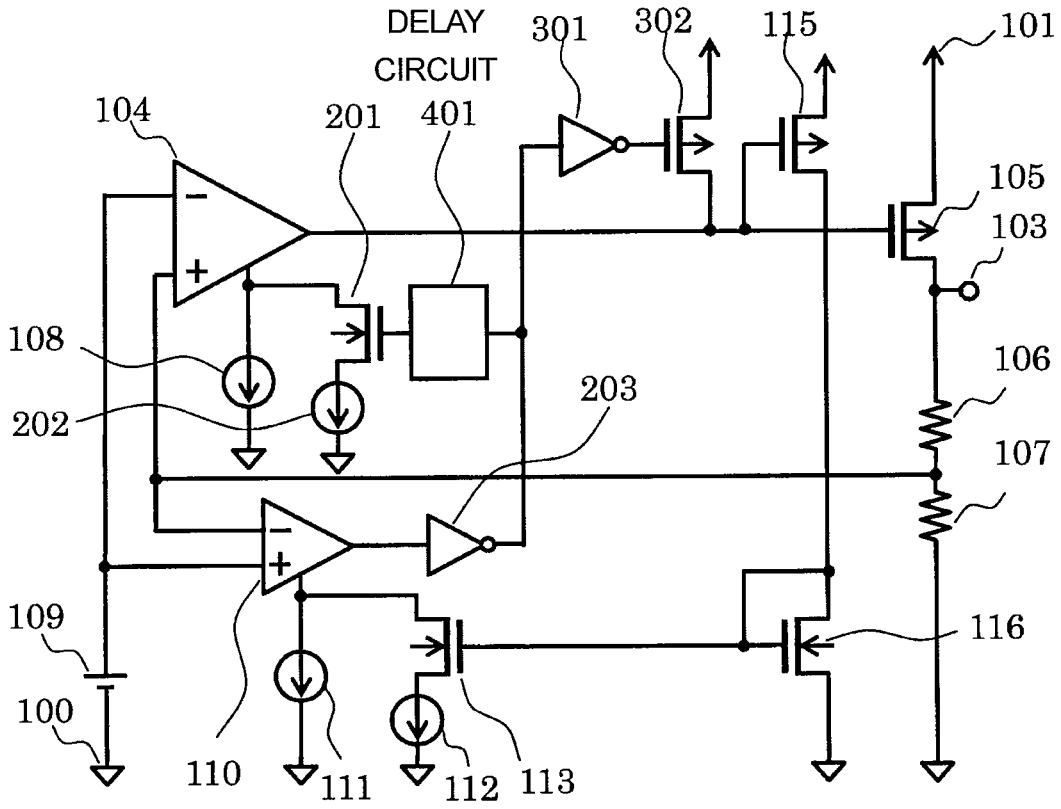
FIG. 4 is a circuit diagram of a voltage regulator according to a fourth embodiment.
Figure 5:
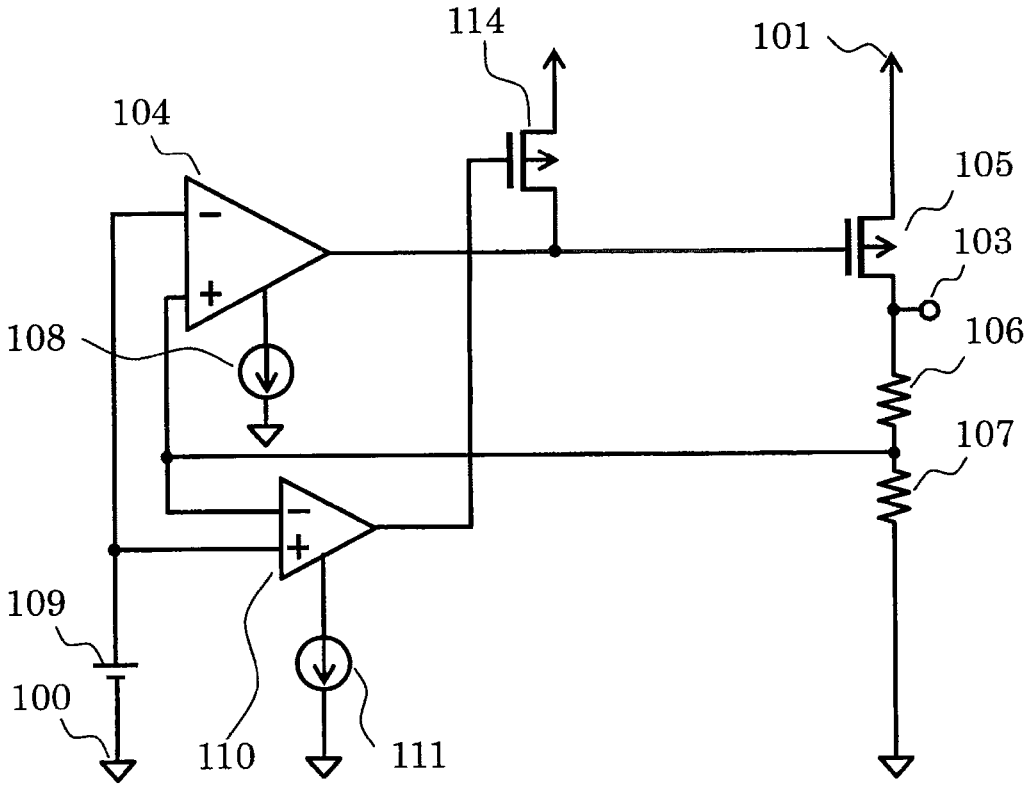
FIG. 5 (PRIOR ART)
FIG. 5 is a circuit diagram showing a conventional voltage regulator.

FIG. 4 is a circuit diagram of a voltage regulator according to a fourth embodiment. This is different from FIG. 3 in that a delay circuit 401 is provided between the output of the inverter 203 and the gate of the NMOS transistor 201. The delay circuit 401 desirably is a circuit to delay the cancellation.

The voltage regulator of the fourth embodiment is configured so that, when overshoot converges and the amplifier 110 outputs a cancellation signal, then following turning-OFF of the PMOS transistor 302, the delay circuit 401 turns the NMOS transistor 201 OFF after predetermined duration. This means that, since the driving current as the output of the error amplification circuit 104 is high for a while after the convergence of the overshoot, duration to control the gate of the PMOS transistor 105 to be appropriate voltage can be shortened. Thereby, undershoot, which may occur after the convergence of overshoot, can be prevented.

As stated above, the voltage regulator of the fourth embodiment increases bias current of the amplifier 110 in the non-regulate state, whereby if overshoot occurs at the output terminal 103, the overshoot can be detected quickly, and overshoot in the non-regulate state can be prevented. The voltage regulator of the fourth embodiment further can prevent the occurrence of undershoot after convergence of the overshoot.

<Fifth Embodiment>

Figure 6:
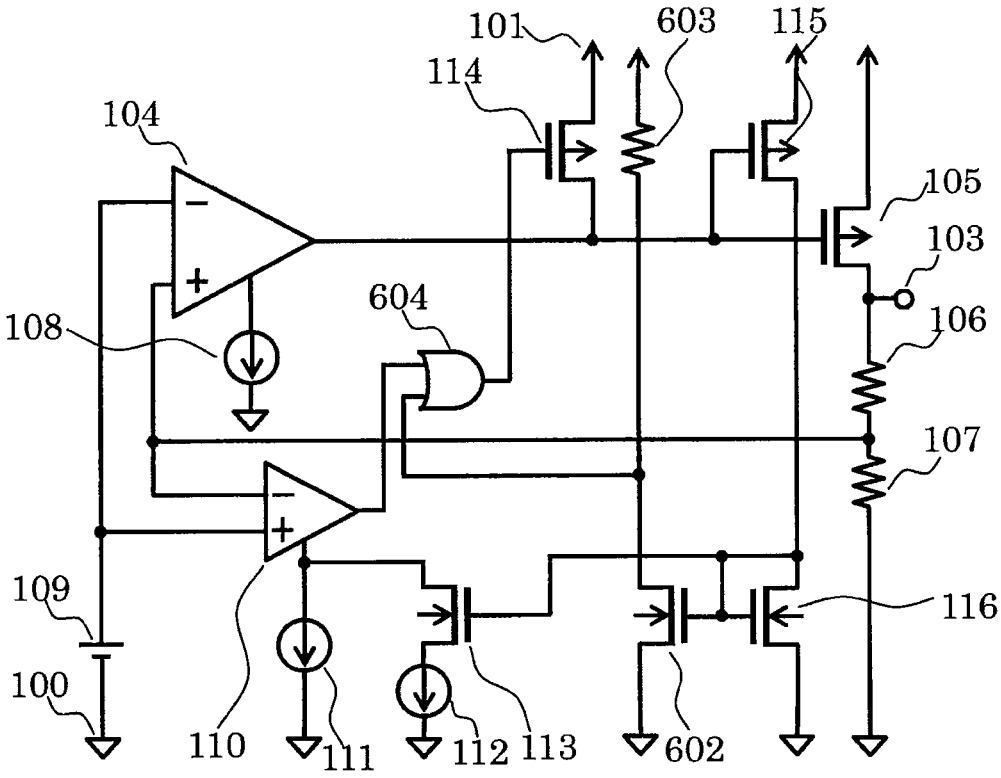
FIG. 6 is a circuit diagram of a voltage regulator according to a fifth embodiment.

FIG. 6 is a circuit diagram of a voltage regulator according to a fifth embodiment. This is different from FIG. 1 in that a NMOS transistor 602, a resistor 603 and an OR circuit 604 are provided. The NMOS transistor 602 has a gate connected to the gate and the drain of the NMOS transistor 116, a drain connected to the resistor 603 and a first input terminal of the OR circuit 604, and a source connected to the ground terminal 100. The other terminal of the resistor 603 is connected to the power supply terminal 101. The OR circuit 604 has a second input terminal connected to the output terminal of the amplifier 110 and an output terminal connected to the gate of the PMOS transistor 114.

Next the following describes an operation of the voltage regulator of the fifth embodiment. The operation in a normal state is similar to the voltage regulator of the first embodiment, and so the description is omitted. In the non-regulate state, since a Lo signal is input to the gate of the PMOS transistor 115, the PMOS transistor 115 turns ON to let current pass therethrough. The NMOS transistor 116 and the NMOS transistors 113, 602 make up a current mirror circuit such that the NMOS transistor 116 lets current from the PMOS transistor 115 pass therethrough, whereby the current flows through the NMOS transistors 113 and 602. The bias circuit 112 limits current flowing through the NMOS transistor 113, and so the current flowing through the NMOS transistor 113 can be kept to be the same current as that flowing through the bias circuit 112 irrespective of an increase of the current flowing through the PMOS transistor 115. In this way, the amplifier 110 enables quick response because the current of the bias circuit 111 and the bias circuit 112 flows as the bias current. A Lo signal is input to the first input terminal of the OR circuit 604.

At this time, if overshoot occurs at the output terminal 103 of the voltage regulator, the amplifier 110 outputs a Lo signal to the second input terminal of the OR circuit 604 because the divided voltage Vfb of the inverting input terminal becomes higher than the reference voltage Vref. In this way, the output terminal of the OR circuit 604 outputs a Lo signal, thus turning the PMOS transistor 114 ON and controls the gate of the PMOS transistor 105 to be voltage at a level close to the power supply voltage. In this way, overshoot at the output terminal 103 of the voltage regulator can be prevented.

When the non-regulate state is cancelled, current corresponding to a load connected to the output terminal 103 flows through the PMOS transistor 115, and current corresponding to the load flows through the NMOS transistor 602 as well. When the current corresponding to the load connected to the output terminal 103 flows, since the current mirror circuit made up of the NMOS transistors 116, 602 have a mirror ratio so that the current becomes smaller than the current flowing through the resistor 603. This means that a High signal is input to the first input terminal of the OR circuit 604, and the output of the OR circuit 604 outputs a High signal. In this way, the PMOS transistor 114 turns OFF for quick shift to a normal state operation, whereby overshoot can be prevented only for fluctuation from the non-regulate state. Due to the quick shift to the normal operation, undershoot, which may occur after preventing overshoot, can be prevented.

Although not illustrated, in another possible configuration, as shown in FIG. 2, the output of the OR circuit 604 is connected to the gate of the NMOS transistor 201 via an inverter, and then if overshoot is detected, the bias circuit 202 is connected to the error amplification circuit 104 so as to increase bias current of the error amplification circuit 104, thus preventing overshoot. The control method for the voltage regulator of the fifth embodiment is not limited to this circuit as long as overshoot can be prevented only in the non-regulate state.

As stated above, the voltage regulator of the fifth embodiment can prevent overshoot only in the non-regulate state. Then, undershoot, which may occur after preventing overshoot, can be prevented.

<Sixth Embodiment>

Figure 7:
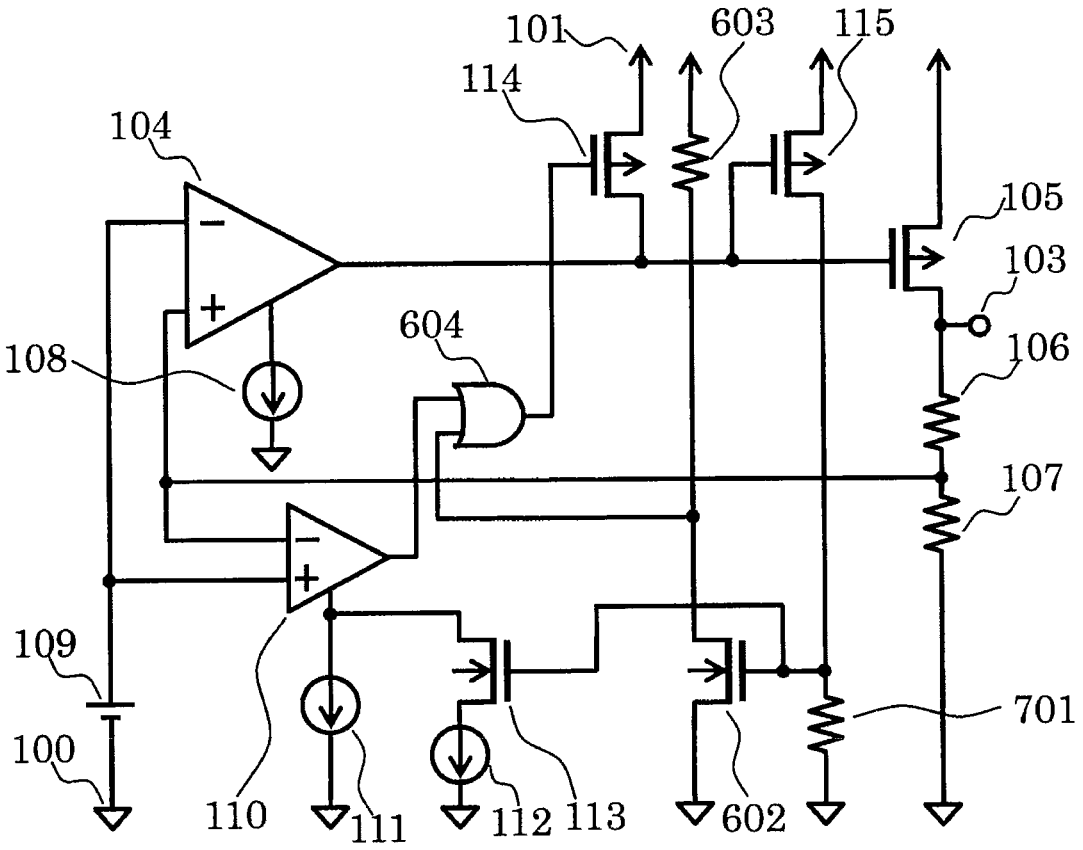
FIG. 7 is a circuit diagram of a voltage regulator according to a sixth embodiment.

FIG. 7 is a circuit diagram of a voltage regulator according to a sixth embodiment. This is different from FIG. 6 in that, instead of the NMOS transistor 116, a resistor 701 is provided. The NMOS transistor 602 has a gate connected to the resistor 701, the drain of the PMOS transistor 115 and the gate of the NMOS transistor 113, a drain connected to the resistor 603 and the first input terminal of the OR circuit 604, and a source connected to the ground terminal 100. The other terminal of the resistor 701 is connected to the ground terminal 100.

Next the following describes an operation of the voltage regulator of the sixth embodiment. The operation in a normal state is similar to the voltage regulator of the first embodiment, and so the description is omitted. In the non-regulate state, since a Lo signal is input to the gate of the PMOS transistor 115, the PMOS transistor 115 turns ON to let current pass therethrough. Voltage is applied to the resistor 701 due to the current of the PMOS transistor 115, and the gates of the NMOS transistor 602 and the NMOS transistor 113 become High, thus turning the NMOS transistor 602 and the NMOS transistor 113 ON. In this way, the bias circuit 112 is connected to the amplifier 110, and since the bias current of the amplifier 110 increases, the amplifier 110 enables quick response. A Lo signal is input to the first input terminal of the OR circuit 604.

At this time, if overshoot occurs at the output terminal 103 of the voltage regulator, the amplifier 110 outputs a Lo signal to the second input terminal of the OR circuit 604 because the divided voltage Vfb of the inverting input terminal becomes higher than the reference voltage Vref. In this way, the output terminal of the OR circuit 604 outputs a Lo signal, thus turning the PMOS transistor 114 ON and controls the gate of the PMOS transistor 105 to be voltage at a level close to the power supply voltage. In this way, overshoot at the output terminal 103 of the voltage regulator can be prevented.

When the non-regulate state is cancelled, the PMOS transistor 115 turns OFF, thus turning the NMOS transistor 602 OFF, and a High signal is input to the first input terminal of the OR circuit 604, and the output of the OR circuit 604 outputs a High signal. In this way, the PMOS transistor 114 turns OFF for quick shift to a normal state operation, whereby overshoot can be prevented only for fluctuation from the non-regulate state. Due to the quick shift to the normal operation, undershoot, which may occur after preventing overshoot, can be prevented.

Although not illustrated, in another possible configuration, as shown in FIG. 2, the output of the OR circuit 604 is connected to the gate of the NMOS transistor 201 via an inverter, and then if overshoot is detected, the bias circuit 202 is connected to the error amplification circuit 104 so as to increase bias current of the error amplification circuit 104, thus preventing overshoot. The control method for the voltage regulator of the sixth embodiment is not limited to this circuit as long as overshoot can be prevented only in the non-regulate state.

As stated above, the voltage regulator of the sixth embodiment can prevent overshoot only in the non-regulate state. Then, undershoot, which may occur after preventing overshoot, can be prevented.

What is claimed is:

1. A voltage regulator, comprising:

an error amplification circuit that amplifies a difference between a reference voltage and a divided voltage that is obtained by dividing an output voltage output from an output transistor and outputs a resultant thereof, thus controlling a gate of the output transistor; and an amplifier that compares the reference voltage and the divided voltage to detect overshoot at the output voltage, wherein the voltage regulator further comprises:

a first transistor that lets current that is proportional to current flowing through the output transistor pass therethrough;

a first current mirror circuit that mirrors the current that is proportional to the current flowing through the output transistor; and a first bias circuit connected to the amplifier via the first current mirror circuit, wherein an output voltage of the output transistor is derived from a source voltage of the voltage regulator, and when the source voltage falls below a level necessary for the voltage regulator to regulate the output voltage, the first bias circuit increases bias current of the amplifier to increase a response speed of the amplifier.

2. The voltage regulator according to claim 1, further comprising:

a second transistor connected to an output of the amplifier; and a second bias circuit connected to the error amplification circuit via the second transistor, the second bias circuit increasing driving current of an output of the error amplification circuit.

3. The voltage regulator according to claim 2, further comprising: a delay circuit between the output of the amplifier and the second transistor.

4. The voltage regulator according to claim 3, further comprising: a third transistor that controls gate voltage of the output transistor based on the output of the amplifier.

5. The voltage regulator according to claim 2, further comprising: a third transistor that controls a gate voltage of the output transistor based on the output of the amplifier.

6. The voltage regulator according to claim 1, further comprising:

a second current mirror circuit that mirrors current that is proportional to current flowing through the output transistor and detects a non-regulate state; and a logic circuit that receives, as inputs, an output signal of the second current mirror circuit and an output signal of the amplifier, wherein in the non-regulate state, the logic circuit outputs the output signal of the amplifier.

7. A voltage regulator, comprising:

an error amplification circuit that amplifies a difference between a reference voltage and a divided voltage that is obtained by dividing an output voltage output from an output transistor and outputs a resultant thereof, thus controlling a gate of the output transistor; and an amplifier that compares the reference voltage and the divided voltage to detect overshoot at the output voltage, wherein the voltage regulator further comprises:

a first transistor that lets current that is proportional to current flowing through the output transistor pass therethrough;

a resistor that generates voltages based on current from the first transistor;

a first bias circuit connected to the amplifier via a second transistor that turns ON in response to voltage generated at the resistor, wherein an output voltage of the output transistor is derived from a source voltage of the voltage regulator, and when the source voltage falls below a level necessary for the voltage regulator to regulate the output voltage, the first bias circuit increases bias current of the amplifier to increase a response speed of the amplifier;

a third transistor that turns ON in response to voltage generated at the resistor and detects a non-regulate state; and a logic circuit that receives, as inputs, an output signal of the third transistor and an output signal of the amplifier, wherein in the non-regulate state, the logic circuit outputs the output signal of the amplifier.

8. The voltage regulator according to claim 7, further comprising: a fourth transistor, to which an output signal of the logic circuit is input, that controls gate voltage of the output transistor based on the output signal of the logic circuit.

9. The voltage regulator according to claim 7, further comprising:

a fifth transistor connected to an output of the logic circuit; and a second bias circuit connected to the error amplification circuit via the fifth transistor, the second bias circuit increasing driving current of an output of the error amplification circuit.

* * * * *